US009353473B2

(12) United States Patent
Park et al.

(10) Patent No.: US 9,353,473 B2
(45) Date of Patent: May 31, 2016

(54) LAUNDRY TREATING APPARATUS WITH MOVING HANGER BAR

(75) Inventors: Dae Yun Park, Changwon-si (KR); Jong Seok Kim, Changwon-si (KR); Dong Won Kim, Changwon-si (KR); Sung Min Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1165 days.

(21) Appl. No.: 13/144,899

(22) PCT Filed: Jan. 13, 2010

(86) PCT No.: PCT/KR2010/000209

§ 371 (c)(1),
(2), (4) Date: Sep. 30, 2011

(87) PCT Pub. No.: WO2010/082759

PCT Pub. Date: Jul. 22, 2010

(65) Prior Publication Data

US 2012/0017654 A1 Jan. 26, 2012

(30) Foreign Application Priority Data

Jan. 15, 2009 (KR) ..... 10-2009-0003379
Dec. 15, 2009 (KR) ..... 10-2009-0124569

(51) Int. Cl.
*D06F 58/12* (2006.01)
*D06F 73/02* (2006.01)

(52) U.S. Cl.
CPC ..... *D06F 58/12* (2013.01); *D06F 73/02* (2013.01)

(58) Field of Classification Search
CPC ..... D06F 58/10; D06F 58/12; A47B 61/003; A47B 61/02
See application file for complete search history.

(56) References Cited

U.S. PATENT DOCUMENTS

| | | | | |
|---|---|---|---|---|
| 1,602,315 | A | 10/1926 | Wood | |
| 3,283,914 | A * | 11/1966 | Robinson | 211/123 |
| 2003/0223309 | A1 | 12/2003 | Hapke | |
| 2005/0035076 | A1 | 2/2005 | Schober et al. | |
| 2006/0037209 | A1 * | 2/2006 | Johnson et al. | 34/90 |
| 2006/0101867 | A1 * | 5/2006 | Kleker | 68/5 C |
| 2007/0241143 | A1 * | 10/2007 | Box et al. | 223/85 |

FOREIGN PATENT DOCUMENTS

| | | |
|---|---|---|
| DE | 2156607 | 5/1973 |
| GB | 1347800 A | 2/1974 |
| JP | 2002-000997 | 1/2002 |
| JP | 2006-130157 A | 5/2006 |
| WO | WO 2008/002047 | 1/2008 |
| WO | WO 2008/002047 A2 | 1/2008 |

* cited by examiner

*Primary Examiner* — Jason Ko
*Assistant Examiner* — Spencer Bell
(74) *Attorney, Agent, or Firm* — Dentons US LLP

(57) ABSTRACT

A laundry treating apparatus is disclosed. The laundry treating apparatus (100) includes a treating chamber (110) to accommodate laundry; a supply device (120) to supply at least one of heated air and steam to the treating chamber (110); a hanger bar (150) provided in the treating chamber; and a driving part (113) to generate a rotational force, wherein the hanger bar (150) comprises a hanger groove (151) having a hanger (200) hung thereon and the hanger groove (151) is configured of plural steps having different widths (W1, W2), respectively.

8 Claims, 13 Drawing Sheets

LAUNDRY TREATING APPARATUS WITH MOVING HANGER BAR

This application is a National Stage Entry of International Application No. PCT/KR2010/000209, filed Jan. 13, 2010, and claims the benefit of Korean Application No. 10-2009-0003379, filed on Jan. 15, 2009, and Korean Application No. 10-2009-0124569, filed on Dec. 15, 2009, all of the applications are hereby incorporated by reference for all purposes as if fully set forth herein.

TECHNICAL FIELD

The present invention relates to a laundry treating apparatus, more particularly, to a laundry treating apparatus that operates efficiently with a hanger hung therein.

BACKGROUND ART

Cloth treating apparatuses typically include washers for washing laundry, dryers for drying wet laundry, refreshers for refreshing laundry and steamers for removing unnecessary wrinkles of laundry.

The refreshes, more specifically, are electric appliances enabling the laundry to be pleasant and fresh, with functions of supplying aromatic material to the laundry, preventing static-laundry and removing wrinkles of the laundry. The steamers are electric appliances capable of simply removing wrinkles of the laundry by using steam supplied to the laundry. Different from conventional irons, such the steamer removes the wrinkles of the laundry sensitively because a heating plate is not in direct contact with the laundry.

DISCLOSURE OF INVENTION

Technical Problem

Such the refresher and the laundry treating apparatus having a function as steamer may remove wrinkles and unpleasant smell of the laundry introduced therein by using both steam and heated air. This function enables the laundry accommodated in the laundry treating apparatus to be relieved of unpleasant smell particles and wrinkles such that an ironing effect may occur.

Technical Solution

To solve the problems, an object of the present invention is to provide a laundry treating apparatus including a driving part provided on an outside of a treating chamber only to improve space utility of the treating chamber.

Another object of the present invention is to provide a laundry treating apparatus that is able to minimize space required in installation by reducing the length of the apparatus in a width direction.

To achieve these objects and other advantages and in accordance with the purpose of the invention, as embodied and broadly described herein, a laundry treating apparatus includes a treating chamber to accommodate laundry; a supply device to supply at least one of heated air and steam to the treating chamber; a hanger bar provided in the treating chamber; and a driving part to generate a rotational force, wherein the hanger bar comprises a hanger groove having a hanger hung thereon and the hanger groove is configured of plural steps having different widths, respectively.

In another aspect of the present invention, a laundry treating apparatus includes a treating chamber to accommodate laundry; a supply device to supply at least one of heated air or steam to the treating chamber; a hanger bar provided in the treating chamber; and a driving part to drive the hanger bar, wherein the hanger bar comprises a hanger groove which various types of hangers are able to be hung on, the hanger groove having plural steps.

In a further aspect of the present invention, a laundry treating apparatus includes a treating chamber to accommodate laundry; a supply device comprising an air supply device to supply air or heated air to the treating chamber and a steam generation device to supply steam to the treating chamber; a moving hanger comprising a hanger bar provided in the treating chamber and a driving part to move the hanger bar, wherein the hanger bar comprises a hanger groove to accommodate a hanging portion of a hanger and the width of each end of the hanger groove formed in a width direction of the hanger bar is larger than the width of a center of the hanger groove.

Advantageous Effects

The present invention has following advantageous effects.

According to the laundry treating apparatus, drying, deodorizing, wrinkle-removing and sterilizing of laundry may be performed smoothly and efficiently.

Furthermore, the laundry treating apparatus according to the present invention may prevent damage to fabric of the laundry and reduce power consumption advantageously.

A still further, various types of hangers may be hung inside the laundry treating apparatus according to the present invention.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

As follows, an exemplary embodiment of the present invention will be described in reference to the accompanying drawings.

Reference will now be made in detail to the specific embodiments of the present invention, examples of which are illustrated in the accompanying drawings.

Wherever possible, the same reference numbers will be used throughout the drawings to refer to the same or like parts.

As follows, the present invention will be described in reference to the drawings to explain a laundry treating apparatus.

Figure 1:
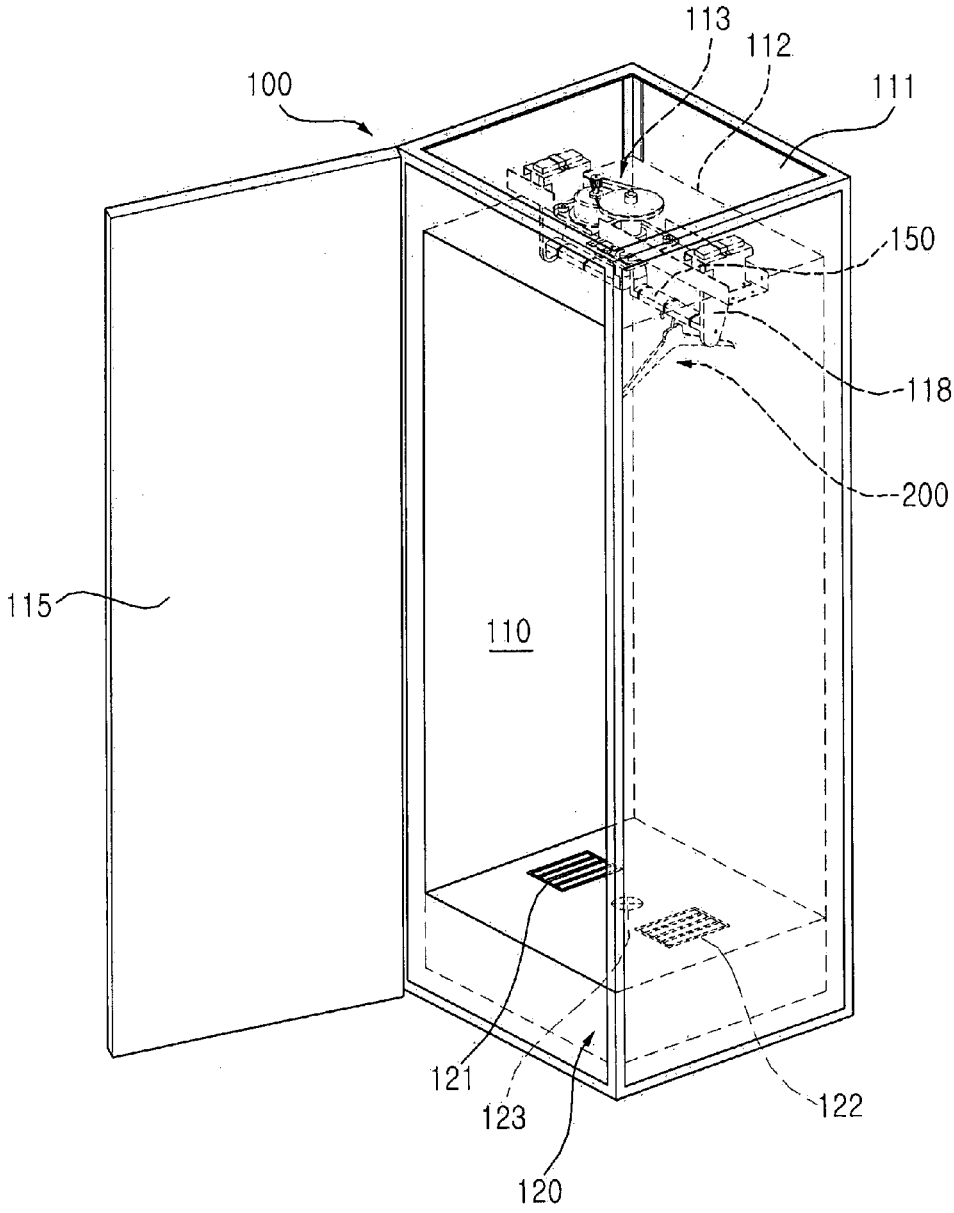
FIG. 1 is a perspective view illustrating a laundry treating apparatus 100 according to an exemplary embodiment of the present invention.
Figure 2:
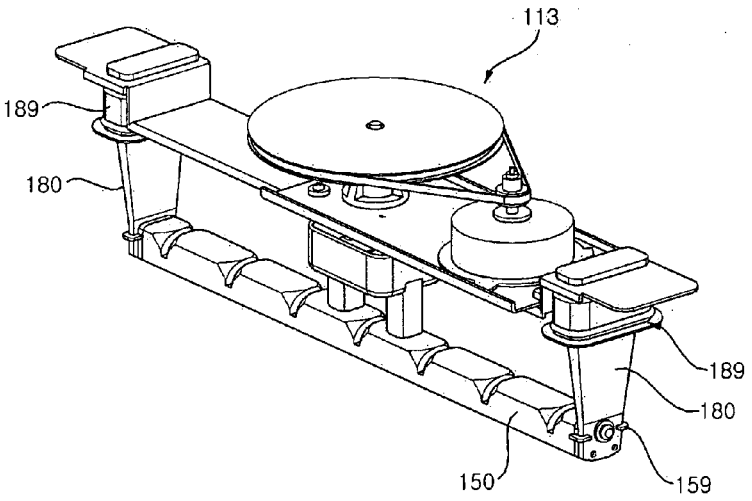
FIG. 2 is an enlarged perspective view illustrating key parts of the laundry treating apparatus 100 shown in FIG. 1.

FIG. 1 is a perspective view a perspective view illustrating a laundry treating apparatus 100 according to an exemplary embodiment of the present invention. FIG. 2 is a perspective view partially illustrating key parts of the laundry treating apparatus shown in FIG. 1.

The laundry treating apparatus 100 according to an exemplary embodiment of the present invention includes an outer cabinet 111 defining an external appearance thereof and an inner cabinet 112 provided in the external cabinet 110. The inner cabinet 112 defines a treating chamber 110 formed therein.

The treating chamber 110 includes an opening formed in one side thereof to load and unload laundry there through. The opening is opened and closed by a door 15. Once the door 115 is closed, the treating chamber 110 is shut off from the outside and once the door 115 is opened, the treating chamber 110 is exposed to the outside.

Heated air or steam is applied to the laundry in the treating chamber 110 to treat the laundry physically or chemically. That is, the treating chamber is the space in which the laundry is treated in various methods, for example, heated air is supplied to dry the laundry or steam is supplied to remove wrinkles or aromatic material is sprayed to treat the laundry having a pleasant fragrance or anti-static material is sprayed to prevent the laundry from being static.

A supply device 120 is mounted below the treating chamber 110. More specifically, the supply device 120 is provided in a space between the outer cabinet 11 and the inner cabinet 112 to be located below the treating chamber 110. Here, the supply device 120 sucks internal air of the treating chamber 110 and it heats the sucked air to ventilate the heated air into the treating chamber. Or, the supply device 120 heats water received therein enough to generate steam and it discharges the generated steam into the treating chamber 110. Here, the supply device 120 may be embodied to supply the heated air and steam simultaneously or to supply either of the two selectively. The supply device 120 may be embodied as various devices to supply the heated air and/or steam to the treating chamber 110 by those skilled in the art.

According to this embodiment, the supply device 120 includes an air inlet 121 to suck air inside the treating chamber 110, a heater (not shown) heating the sucked air, a heated air outlet 122 to discharge the air heated by the heater into the treating chamber 110 and a steam outlet 123 to spray steam into the treating chamber 110.

The heated air and/or steam generated by the supply device 120 is applied to the laundry loaded into the treating chamber 110 only to affect the physical or chemical property of the laundry. That is, the fabric texture of the laundry is loosened by the heated air or steam generated by the heating part 120 such that the wrinkles of the laundry may be removed and particles of the unpleasant smell react to the steam such that the unpleasant smell may be removed. In addition, the heated air and/or steam generated by the heating part 120 may sterilize bacteria parasitic on the laundry effectively.

A hanger bar 150 is arranged in the treating chamber 110 to hang a hanger 200 thereon. The detailed description of the hanger bar 150 will be explained later in reference to FIGS. 3 to 5.

A driving part 113 drives the hanger bar 150 and the driving part 113 may be configured of a motor for generating a rotational force, a pulley and belt for transmitting the rotational force and a cam for converting the rotational motion into reciprocating motion, to reciprocate the hanger bar 150. Here, the driving part 113 may reciprocate the hanger bar 150 rightward/leftward.

The driving part 113 may be seated in a driving part frame fixed between the inner cabinet 112 and the outer cabinet 111. The driving part frame is employed to dampen vibration generated during the operation of the driving part 113 as well as to secure the driving part 113 therein.

A supporter 180 is connected to the treating chamber 110, supporting the hanger bar 150. An end of the supporter 180 is secured to the inner cabinet 112 and the other end thereof is secured to the hanger bar 150. A sealing member 189 may be provided in the supporter 180 to prevent the heated air and/or steam generated by the supply device 120 from leaking between the inner frame 112 and the outer frame 111. The supporter 180 may be fastened to the hanger bar 150 by a connection member 159 and the supporter 180 will be described later in reference to FIGS. 7 to 9.

Figure 3:
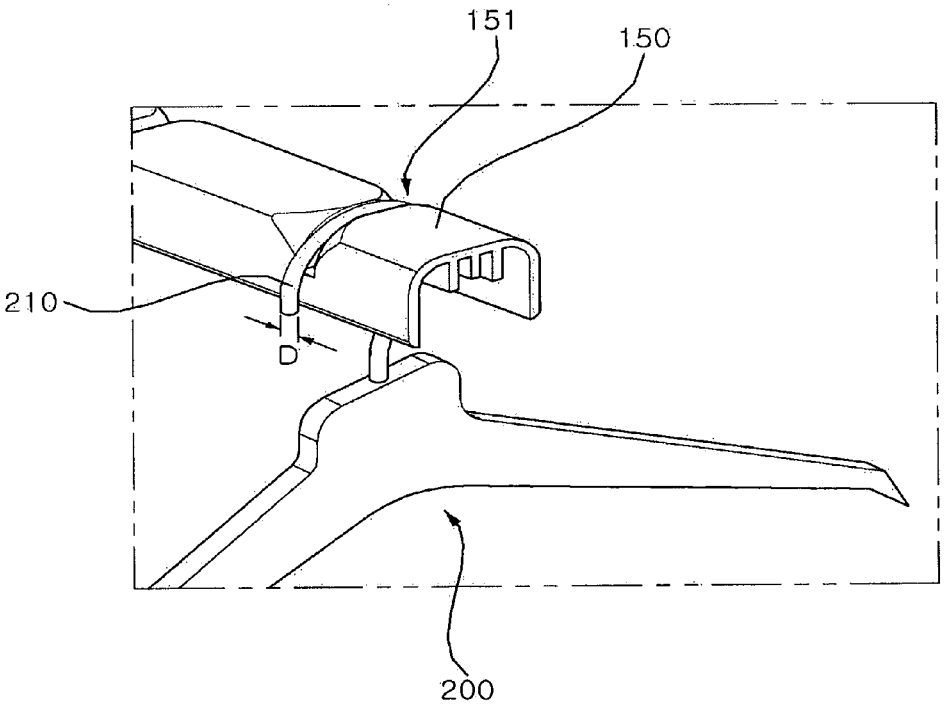
FIG. 3 is an enlarged view partially illustrating a hanger bar of the laundry treating apparatus according to the exemplary embodiment of the present invention.
Figure 4:
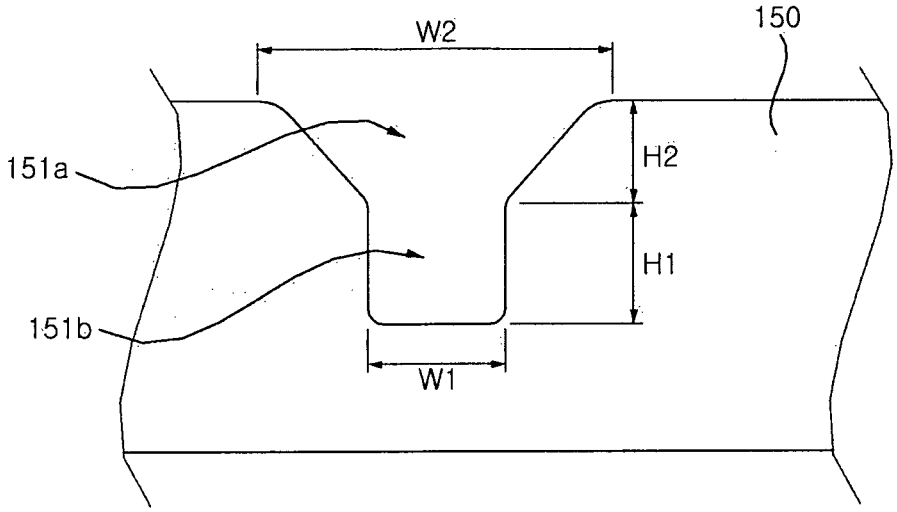
FIG. 4 is a side-sectional view partially illustrating the hanger bar shown in FIG. 3.

FIG. 3 is an enlarged view partially illustrating the hanger bar of the laundry treating apparatus according to the embodiment of the present invention and FIG. 4 is a side-sectional view partially illustrating the hanger bar shown in FIG. 3.

The hanger bar 150 includes a hanger groove 151 having the hanger 200 hung thereon. The hanger groove 151 may have multi-steps for various types of hangers 200 to be hung on. The hanger bar 150 is formed for a hanging portion 210 of the hanger 200 to be hung on even if the hanging portion 210 has diversified sizes and shapes.

A first step groove 151*a* may be formed in the hanger groove 151, with a getting narrower width to have various types of hangers 200 hung thereon. The hanger 200 having a standardized hanging portion 210 is hung on the hanger groove 151 and a second step groove 151*b* having a predetermined width may be connected to a lower portion of the first step groove 151*a*.

If a diameter (D) of the hanging portion 210 where the standardized hanger 200 is hung is regular, the width (W1) of the second step groove 151*b* may be larger than the diameter (D) of the hanging portion 210 of the hanger 200. In this case, when the hanger bar 150 is moved rightward/leftward by the driving part 113, the hanger 200 may be moved rightward/leftward with an impulsive force. Therefore, it will improve laundry treating efficiency.

The preferable ratio of the diameter (D) of the hanging portion 210 to the width (W1) of the second step groove 151*b* is as follows:

$$0.45<D/W1<0.95$$

If the hanger 200 is vibrated at a fast speed, the hanging portion 210 would be moved even a small ratio of the diameter (D) of the hanging portion 210 to the width (W1) of the second step groove 151*b*. However, if the hanger 200 is vibrated at a slow speed, the hanging portion 210 would not be moved the small ratio. As a result, it is preferable that the ratio is limited to the above value.

If the diameter (D) of the hanging portion 210 is regular because of the standardization, the height (H1) of the second step groove 151*b* may be smaller than the diameter (D) of the hanging portion 210 of the hanger 200.

Here, if the height (H1) of the second step groove 151*b* is too smaller than the diameter (D1) of the hanging portion 210, the hanger happens to be leaved from the hanger bar 150 and it is preferable that the height (H1) is limited to a following value:

$$H1>D/3$$

H1/D may be ⅓ or more to embody the minimum number of reciprocation times of the hanger bar 150, such that the laundry may be treated.

Figure 5:
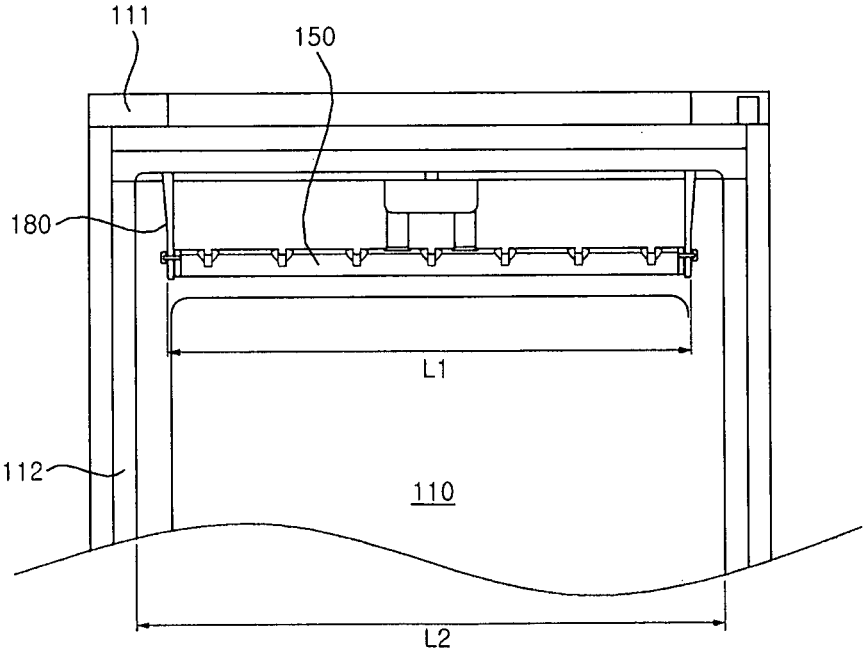
FIG. 5 is a diagram illustrating a configuration of the laundry treating apparatus according to the exemplary embodiment of the present invention.

FIG. 5 is a diagram partially illustrating the configuration of the laundry treating apparatus according to the embodiment of the present invention.

The length (L1) of the hanger bar 150 is smaller than the width (L2) of the treating chamber 110 defined by the inner cabinet 112. The receiving amount of laundry in the treating chamber 110 is increased as the length (L1) of the hanger bar 150 is increased but the length (L1) of the hanger bar 150 should be smaller than the width (L2) of the treating chamber 110 to allow the hanger bar 150 to reciprocate in the right and left direction.

The relation between the length (L1) of the hanger bar 150 and the width (L2) of the treating chamber 110 is as follows:

$$0.7<L1/L2<0.85$$

When L1/L2 has to be larger than 0.7, the maximum amount of the laundry can be accommodated and when L1/L2 has to be smaller than 0.85, the end of the hanger bar 120 may not be in contact with the inside of the treating chamber 110.

Figure 6:
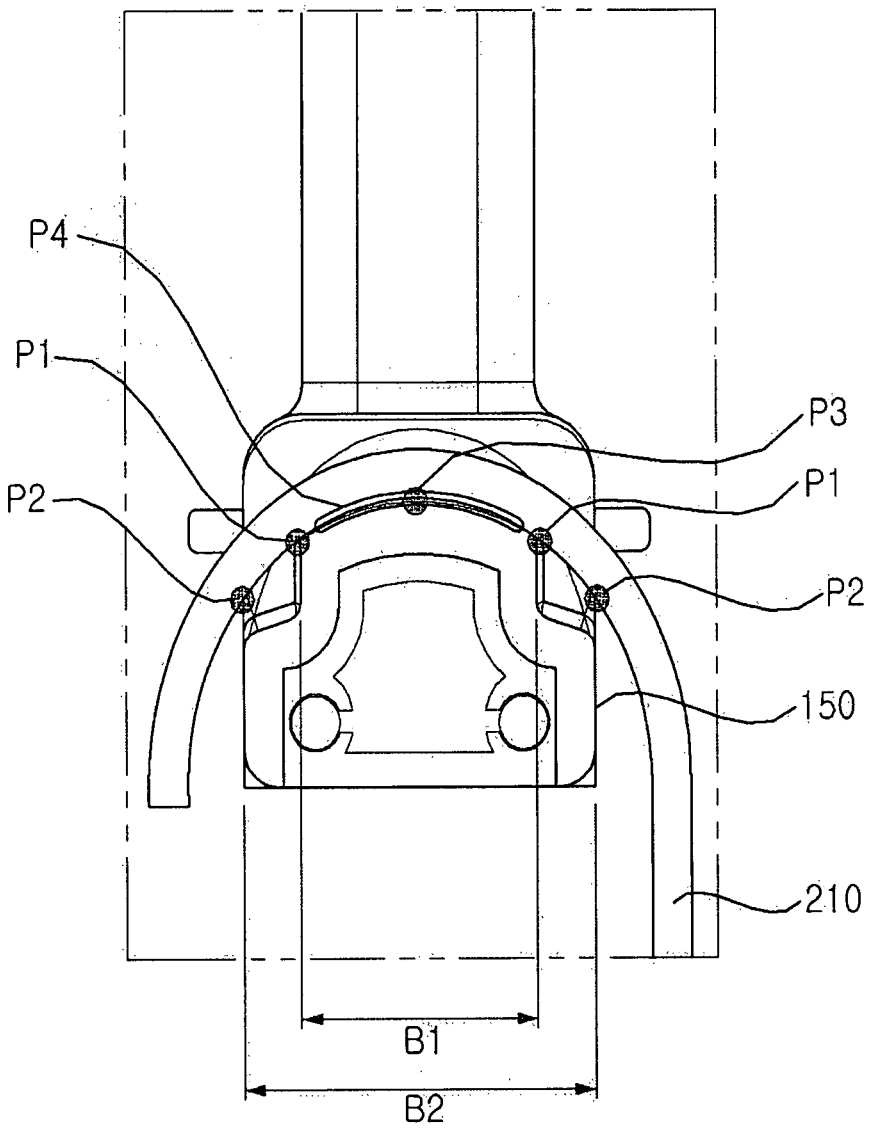
FIG. 6 is a sectional view illustrating the hanger bar of the laundry treating apparatus according to the embodiment of the present invention.

FIG. 6 is a sectional view illustrating the hanger bar of the laundry treating apparatus according to the embodiment of the present invention.

According to the laundry treating apparatus of the embodiment, the overall width (B2) of the hanger bar 150 may be larger than the width (B1) of the portion having the hanging portion 210 of the hanger 200 hung thereon. It would prevent the hanger 200 from being rotated with respect to the hanger groove and colliding the laundry each other when the hanger bar 150 is reciprocating.

The hanger bar 150 may be in contact with the hanging portion 210 of the hanger 200 in various ways. That is, the hanger bar 150 may two-point-contact with the hanging portion 210 in P1 or P2 or four-point-contact with the hanging portion 210 in P1 and P2 or one-point-contact with it in P3. The hanger bar 150 may linear-contact with the hanging portion 210 in P4.

The hanger bar 150 according to the laundry treating apparatus of this embodiment may be coated with rubber material to reduce a tapping sound generated by the hanging portion 210 of the hanger 200. Here, the rubber material may be coated only in the hanger groove 151.

Figure 7:
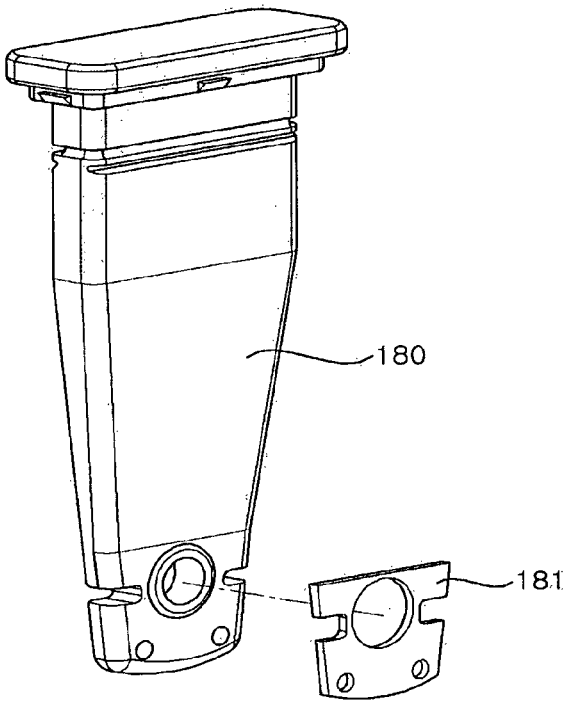
FIG. 7 is a diagram illustrating a supporter of the laundry treating apparatus according to the embodiment of the present invention.

FIG. 7 is a diagram illustrating the supporter of the laundry treating apparatus according to the embodiment of the present invention.

The supporter 180 of the laundry treating apparatus may be formed of flexible material. The reason why the supporter 180 is formed of flexible material is that the hanger bar 150 supported by the supporter 180 has to be reciprocated smoothly.

If the supporter 180 is formed of flexible material, the connection portion between the supporter 180 and the hanger bar 150 may be deformed enough to make the connection portion unstable. As a result, the supporter 180 may include a correcting member 181 having high rigidity. This correcting member 181 is provided in the connection portion of the supporter 180 with the hanger bar 150 to make the supporter 180 connected with the hanger bar 150 stably and support the hanger bar 150 stably. A hole is formed in the correcting member 181 and the hole of the correcting member 181 is larger than a hole of the supporter 180 such that the noise generated during the reciprocation of the hanger bar 150 may be reduced and that the hanger bar 150 may be fastened to the supporter 180 smoothly.

Figure 8:
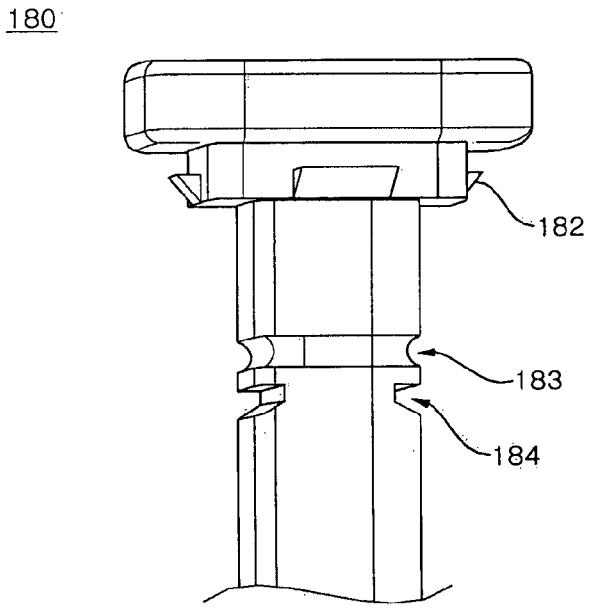
FIG. 8 is an enlarged top-view of the supporter shown in FIG. 7.

FIG. 8 is an enlarged top view illustrating the supporter of FIG. 7.

A projection 182 may be formed in the supporter 180 according to the laundry treating apparatus of the embodiment and the projection 182 is secured to the inner frame 112 to reduce the vibration generated by the reciprocation of the hanger bar 150. Moreover, a sealing member groove 183 may be formed in the supporter 180 and the sealing member 189 is coupled to the sealing member groove 183.

A pivot groove 184 employed as pivot point during the driving of the hanger bar 150 may be formed in the supporter 180 such that the vibration generated by the driving of the hanger bar 150 may not be transmitted upward.

Figure 9:
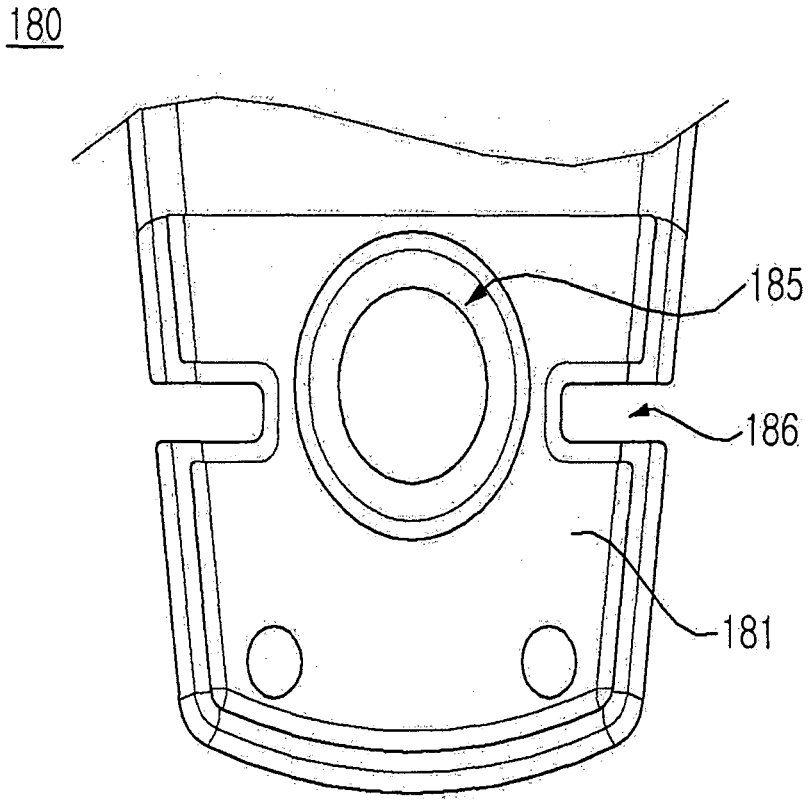
FIG. 9 is an enlarged bottom-view of the supporter shown in FIG. 7.

FIG. 9 is an enlarged bottom view illustrating the supporter of FIG. 7.

A hanger bar hole 185 is formed in the supporter 180 and the hanger bar 150 is coupled to the hanger bar hole 185. The correcting member 181 mentioned above is inserted in an adjacent portion 186 of the hanger bar hole 185.

Moreover, a coupling hole 186 is formed in the supporter 180 and the connecting member 159 shown in FIG. 1 is coupled in the coupling hole 186 such that the hanger bar 150 is prevented from rotating during the driving of the hanger bar 150.

As follows, a laundry treating apparatus according to another embodiment will be described in corresponding drawings.

Figure 10:
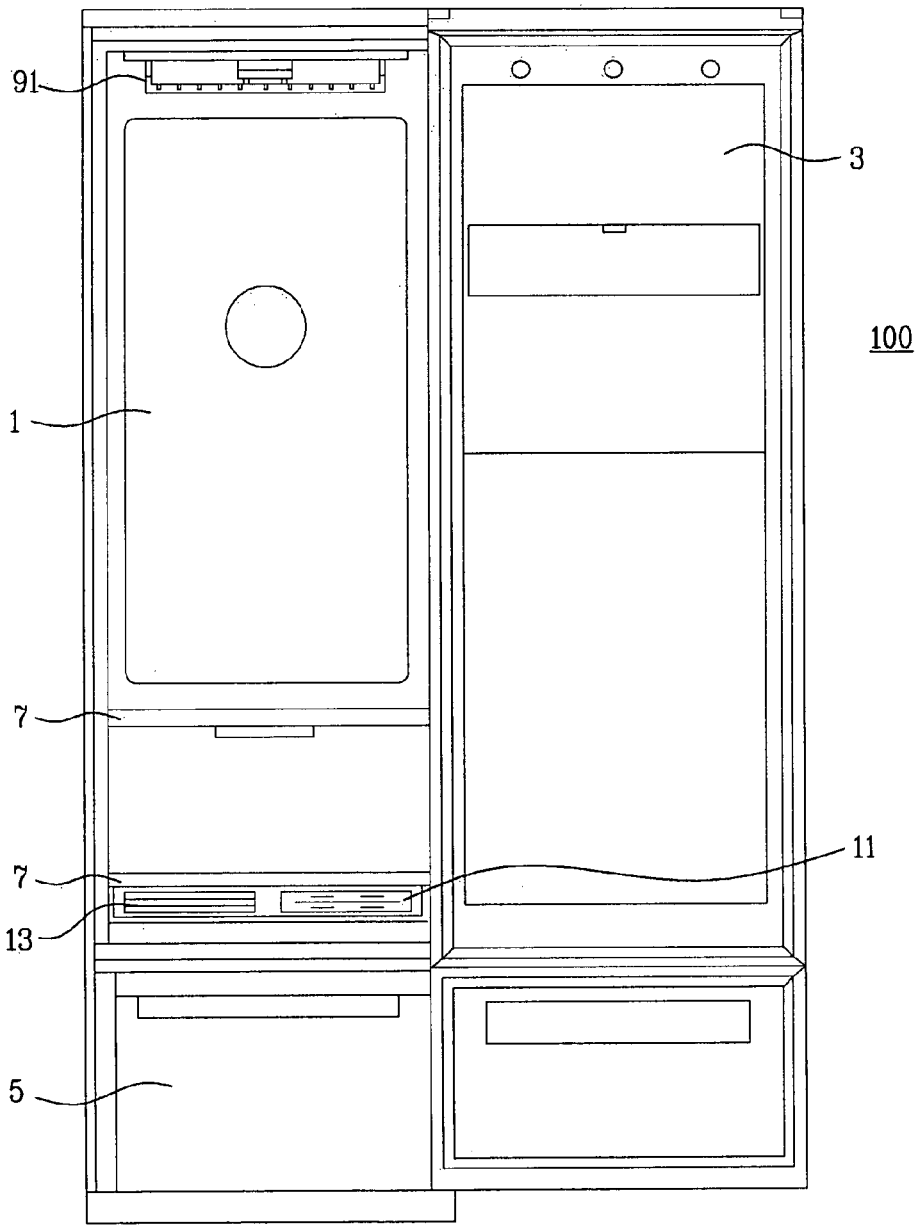
FIG. 10 is a front view of a laundry treating apparatus according to another embodiment of the present invention.

FIG. 10 is a front view illustrating a laundry treating apparatus according to another embodiment, with a door being open.

This specification describes a refresher capable of refreshing and supplying heated air to embody the laundry treating apparatus and the present invention is not limited thereto. The technical subject of the present invention may be applicable to other types of apparatus including a heat pump which will be described later.

Here, the term 'refresh' may be referenced to as a process of removing wrinkles, deodorizing, sanitizing, preventing static electricity or warming with respect to laundry by supplying air, heated air, water, mist, steam and the like to the laundry.

Moreover, the laundry mentioned in this specification may include not only clothes and apparel but also wearable objects such as shoes, socks, gloves, hats and mufflers and usable objects such as dolls, towels, beddings. That is, the laundry may include all kinds of objects that washing is performed to.

In reference to FIG. 10, the laundry treating apparatus 100 according to this embodiment includes an outer cabinet, an inner cabinet 1, a door 3, a supply device 5 having an air supply device and steam generation device, and a support 7 and 91. The outer cabinet defining an exterior appearance of the laundry treating apparatus and the inner cabinet 1 includes a treating chamber where the laundry is accommodated. The door opens and closes the treating chamber of the inner cabinet 1. The air supply device supplies air or heated air to the treating chamber of the inner cabinet 1 and the steam generation device supplying water, mist or steam to the treating chamber. The support 7 and 91 supports the laundry in the inside (the treating chamber) of the inner cabinet.

The inner cabinet 1 includes an air inlet 13 in communication with the air supply device (51, see FIG. 4), a filter part (not shown) and a steam inlet 11 in communication with the steam generation device 53.

Figure 11:
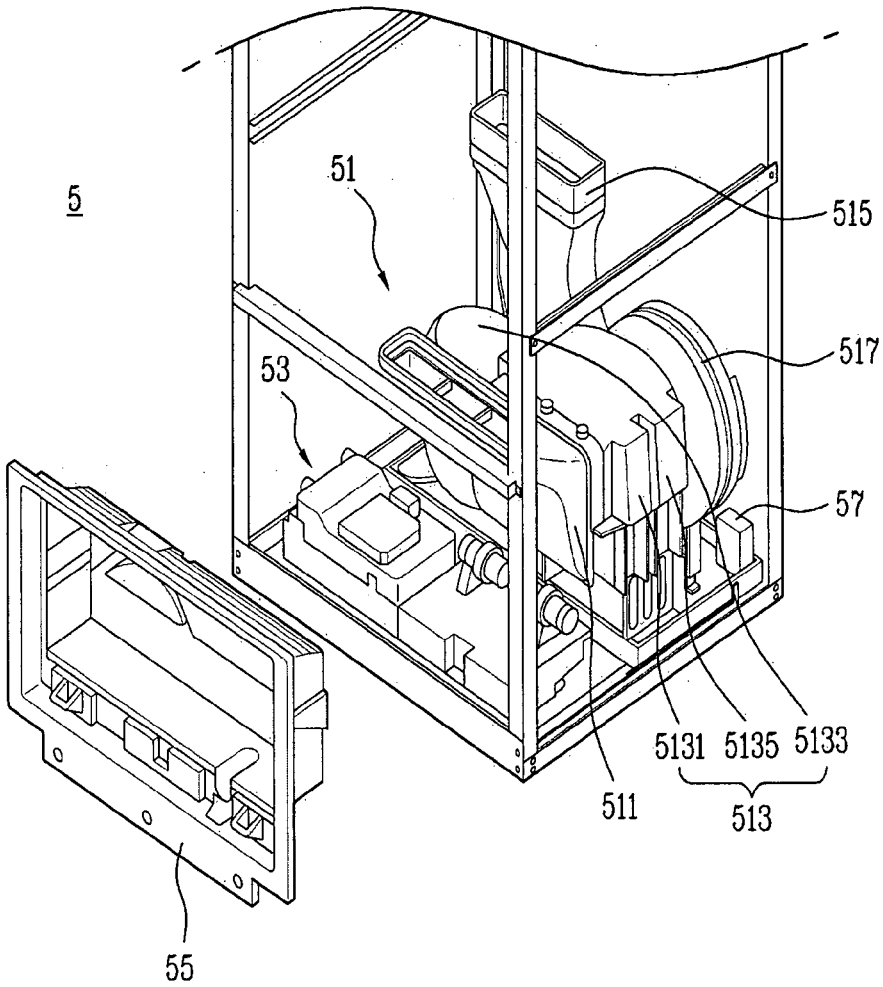
FIG. 11 is a perspective view schematically illustrating an inner configuration of a supply device provided in the laundry treating apparatus.

FIG. 11 is a perspective view schematically illustrating an inner configuration of the supply device 5. FIG. 11 illustrates only key parts including the air supply device 51 for explanation sake and the steam generation device 53 and pipes connecting these elements are not shown.

The supply device 5 includes the air supply device 51 for supplying air or heated air to the inside of the inner cabinet 1 and the steam generation device 53 for supplying water, mist or steam (hereinafter, steam) to the inside of the inner cabinet. Here, the supply device 5 may be provided below the inner cabinet because the heated air and heated steam supplied to the inner cabinet have a property of ascending.

That is, only if the supply device 5 supplies the heated air or steam to the inside of the inner cabinet 1, located below the inner cabinet 1, the heated air or steam may be supplied uniformly without an auxiliary circulation device.

In reference to FIG. 11, the air supply device 51 supplying air or heated air to the treating chamber where the laundry is accommodated (hereinafter, the inside of the inner cabinet) may be located in the supply device 5.

The air supply device according to this embodiment includes an inlet 511 connected to the filter part (not shown) provided in the inner cabinet 1, an outlet 515 connected to the air inlet 13 formed in the inner cabinet and a heat-changing part 513 provided between the inlet and the outlet 511 and 515.

The heat-exchanging part 513 may be a heat pump and the heat pump includes an evaporator 5131, a compressor 5133, a condenser 5135 and an expansion valve (not shown), such that air is dehumidified and heated.

Specifically, latent heat of ambient air is sucked while refrigerator is evaporated in the evaporator 5131 and the air is cooled enough to condense moisture of the air and the moisture is removed. While the refrigerant is condensed in the condenser 5135 after passing the compressor 5133, the latent heat is discharged toward ambient air and the ambient air is heated. As a result, the evaporator and the condenser are functioned as heat-exchanger such that the air drawn into the air supply device 51 may be dehumidified and heated via the evaporator 5131 and the condenser 5135 to be supplied to the inside of the inner cabinet 1.

The air heated by the heat pump may have a relatively low temperature in comparison to the air heated by a conventional electric heater but it may be humidified without using an auxiliary dehumidifying device. Because of that, the air re-supplied to the inside of the inner cabinet by the heat pump may be corresponding to 'relatively low temperature dry air' (here, 'low temperature' may not mean absolutely low temperature but heated air with a relatively low temperature in comparison to the conventional heated air). According to the laundry treating apparatus, such the low temperature dry air is supplied to the laundry and deformity or damage of the laundry may be prevented in case of performing a process such as refreshing or drying process. That is, the air supplied by the heat pump of the laundry treating apparatus according to this embodiment has a lower temperature than the heat air of the conventional laundry treating apparatus and it is dehumidified without any auxiliary dehumidifying devices, such that the laundry may be dried and refreshed efficiently.

The inlet 511 is provided corresponding to the filter part (not shown) of the inner cabinet. As a result, foreign substances that could be contained in the air drawn into the air supply device 51 are filtered by the filter part such that only clean air may be supplied to the inner cabinet.

The outlet 515 may include an exhaustion fan 517 connected to the air inlet 13 of the inner cabinet to blow the air heated by heat-exchanging into the inner cabinet smoothly.

In the meanwhile, the supply device 5 includes the steam generation device 53 capable of supplying steam to the inner cabinet selectively.

The steam generation device 53 includes a heater (not shown) heating water to generate steam. Also, the steam generation device 53 may generate mist by using ultrasonic vibration means (not shown).

An external water tap or a container type water supply source may be used as water supply source to supply water to the steam generation device 53. The container type water supply source is provided in a predetermined portion of the supply device 5.

Such the container type water supply source may be provided in a supply device door 55 detachably installed in the supply device 5 and the container type water supply source may be detachable from the supply device door 55, such that the user may separate the water supply source from the supply device 5 to fill with water and that the user may re-install the water supply source after that.

The steam generated in the steam generation device 53 may be supplied to the inside of the inner cabinet via a spraying nozzle (not shown) provided in the steam inlet 11. Here, the steam generation device 53 is connected with the spraying nozzle (not shown) by a pipe (not shown).

A cooling fan 557 may be provided in a rear portion of the supply device 5 and the cooling fan 57 blows external air into the supply device to prevent the temperature inside the supply device 5 from being increased too high by both of the air supply device 51 and the steam generation device 53.

The support 7 and 91 may be fixed in the inner cabinet to enable the laundry in a state of not moved to be refreshed by the heated air or steam generated from the steam generation device.

That is, the support includes a shelf 7 selectively fixed to an inner circumferential surface of the inner cabinet and a hanger bar 91 fixed to an upper portion of the inner cabinet. In this case, the shelf 7 may be a frame having open top and bottom to pass the heated air or steam supplied by the supply device 5 there through. This is because the heated air or heated steam has to be supplied to the laundry placed on the shelf efficiently and smoothly.

As a result, the laundry introduced into the laundry treating apparatus according to this embodiment may not be tangled unlike the laundry introduced into the conventional drum type laundry treating apparatus, such that a superior effect may be expected in an aspect of drying process as well as the aspect of deodorizing and wrinkle-removing process.

Here, the hanger bar 91 provided in the upper portion of the inner cabinet 1 may be a moving type hanger capable of shaking the laundry horizontally (rightward/leftward or forward/rearward as seen in the drawings). In this case, the moving hanger may shake the laundry while the heated air or steam is supplied to the inside of the inner cabinet, not entangling the laundry, such that the efficiency of drying, deodorizing, wrinkle-removing and sterilizing with respect to the laundry may be improved.

That is, the refresh function may be improved.

Figure 12:
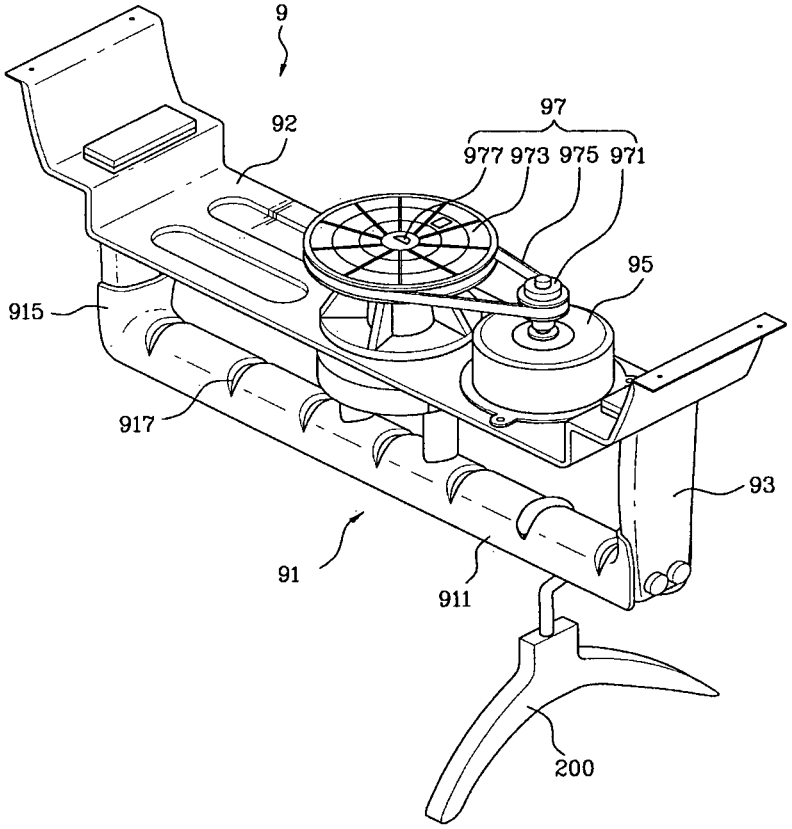
FIG. 12 is a perspective view illustrating a configuration of a moving hanger provided in the laundry treating apparatus.
Figure 13:
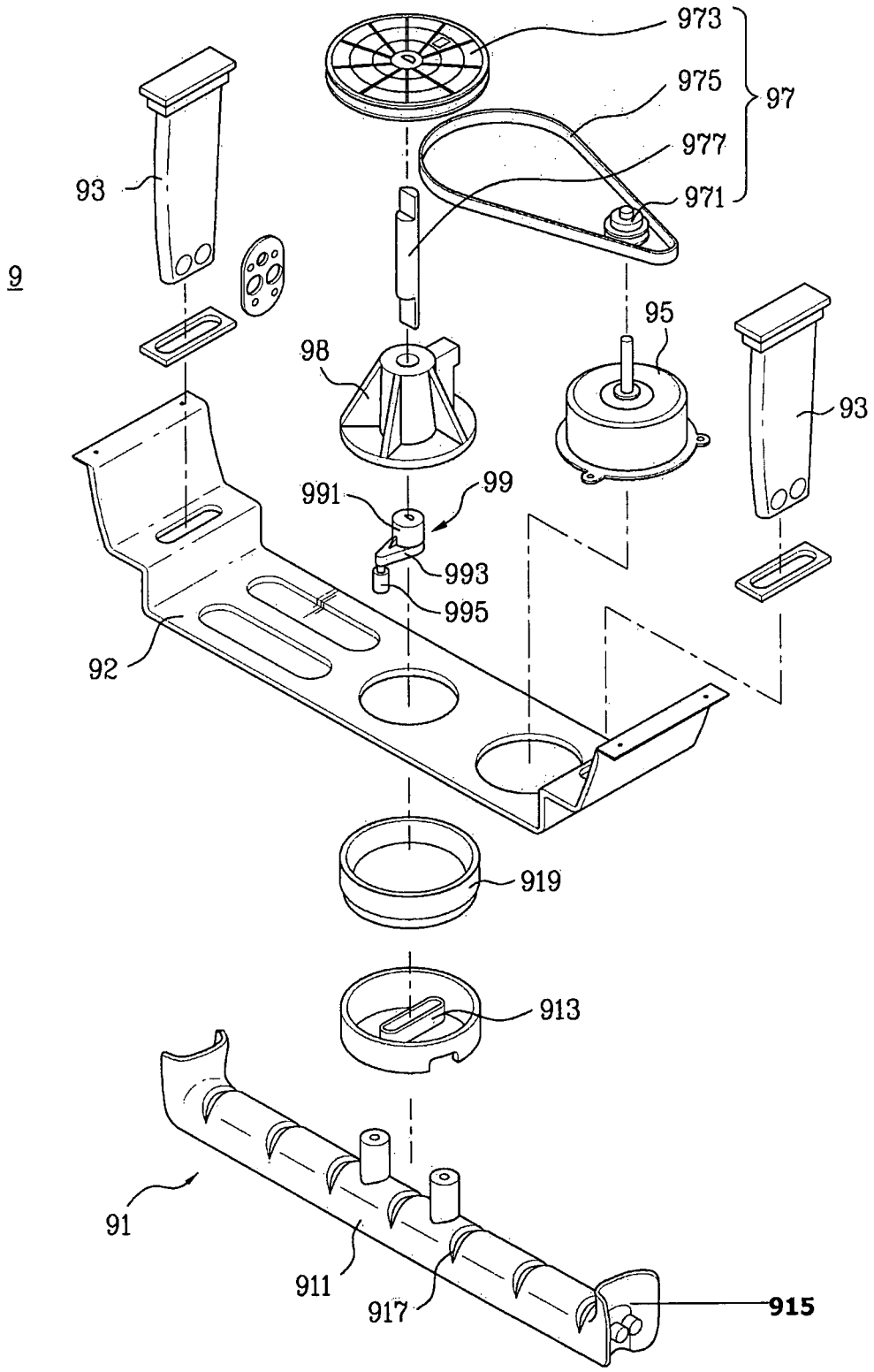
FIG. 13 is an exploded perspective view illustrating the moving hanger.

FIG. 12 is a perspective view illustrating the moving hanger and FIG. 13 is an exploded perspective view illustrating the moving hanger. As follows, the moving hanger will be described in reference to FIGS. 12 and 13. The moving hanger 9 includes a hanger bar 91 supporting the laundry hung on a hanger 200 and a supporter 93 supporting each of ends of the hanger bar 91. the supporter 93 may be provided in an upper surface of the inner cabinet 1 and both ends of the hanger bar 91 is connected to the supporters 93.

As a result, the laundry loaded in the laundry treating apparatus according to this embodiment is in the state of being placed on the hanger. Because of that, the laundry treating apparatus may be expected to have the superior effect in the aspect of drying efficiency as well as refreshing efficiency, compared with the conventional laundry treating apparatus.

The moving hanger 9 includes a driving part for driving the hanger bar 91. The driving part includes a motor 95, a power converting part 99, a power transmitting part 97 and a frame 92. The power converting part 99 converts a rotational motion supplied by the motor into a horizontal linear motion and the power transmitting part 97 transmits a power supplied by the motor 95 to the power converting part 99. The frame 92 is provided in an outer circumferential surface of the inner cabinet to support the above components.

The power transmitting part 97 includes a driving pulley 971 provided in the motor 95, a driven pulley 973 connected with the driving pulley by a belt and a shaft 977 fastened to a center of the driven pulley. The hanger bar 91 may further include a slot 913 orthogonal to its longitudinal direction. The power converting part 99 includes a slot inserted portion 995 inserted in the slot 913, a shaft connected portion 991 connected to the shaft 977 and a rotation arm 993 connecting the slot inserted portion with the shaft connected portion.

In this case, a bearing housing may be further provided between the shaft connected portion and the driven pulley to support the rotation of the shaft, and a power converting part cover 919 may be further provided in the power converting part and it prevents the power converting part from being exposed outside to improve aesthetic appearance of the laundry treating apparatus.

Under the above configuration, the motor 95 is rotated and then the driven pulley 973 is rotated. Hence, the shaft 977 fastened to the driven pulley is rotated and the slot inserted portion 995 performs circular motion with a predetermined diameter.

In the meanwhile, the slot 913 provided in the hanger bar 91 is orthogonal to the longitudinal direction of the hanger bar 91 and a diameter of the slot 913 is larger than a diameter of a rotation locus of the slot inserted portion 995. As a result, the slot 913 may performs linear motion horizontally even when the slot inserted portion 995 performs circular motion.

Because of that, the hanger bar 91 coupled to the slot 913 may performs linear motion horizontally.

Figure 14:
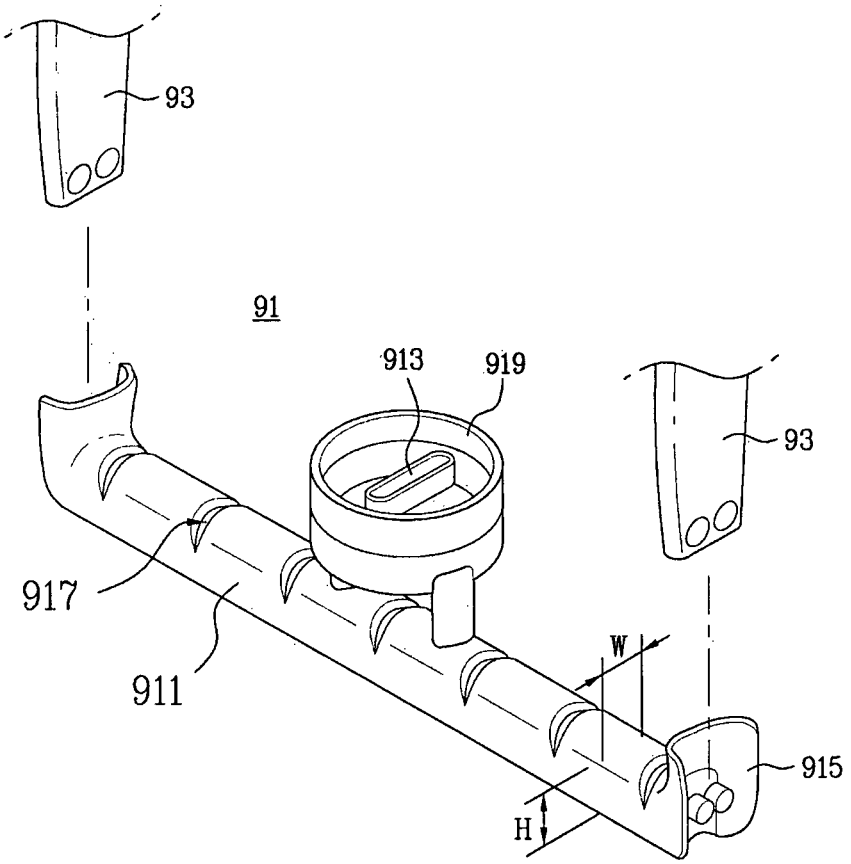
FIG. 14 is a perspective view illustrating a hanger bar of the moving hanger according to this embodiment.

FIG. 14 is a perspective view illustrating a hanger bar according to another embodiment. The hanger bar 91 supporting the hanger 200 may be movable linearly in the horizontal direction by the driving part and it includes a body 911, a slot 913, a supporter coupling rib 915 and a hanger groove 917. The body 911 defines an exterior appearance of the hanger bar 91 and the slot 913 is provided in an upper portion of the body to allow the slot inserted portion 995 of the power converting part inserted therein. The supporter coupling rib 915 surrounds the supporter for the supporter 93 not to be exposed outside. The hanger groove 917 receives a hanging portion of the hanger therein to support the hanger.

Figure 15:
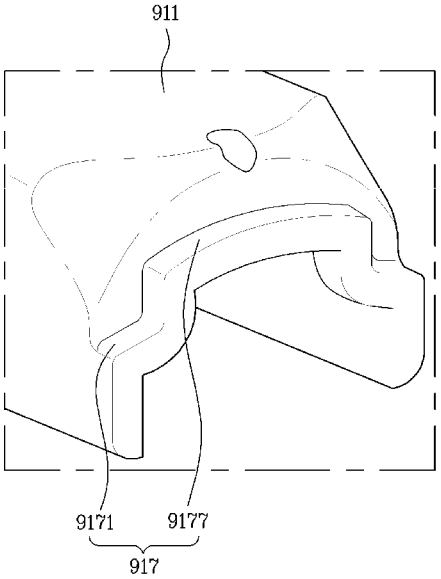
FIG. 15 is a sectional perspective view illustrating the hanger bar.
Figure 16:
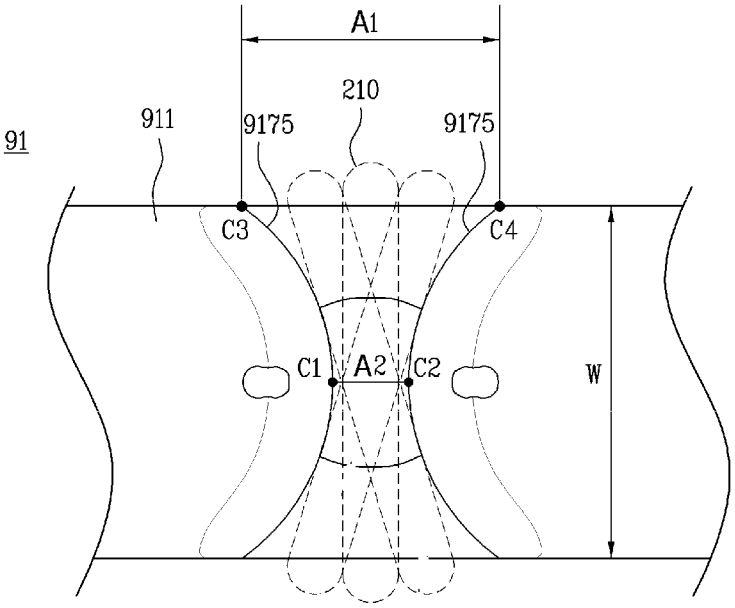
FIG. 16 is a top-sectional view illustrating the hanger bar.
Figure 17:
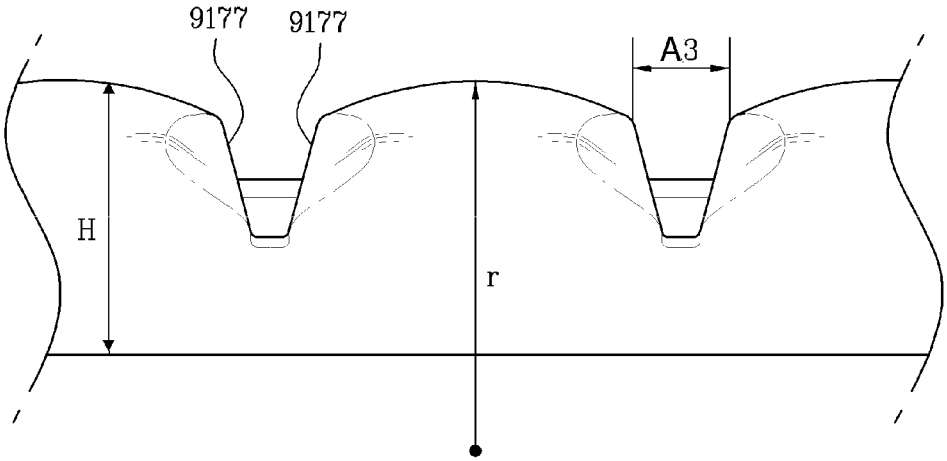
FIG. 17 is a sectional view illustrating the hanger bar in a longitudinal direction.

FIG. 15 is a sectional perspective view illustrating the hanger bar and FIG. 16 is a top side-sectional view illustrating the hanger bar and FIG. 17 is a longitudinal sectional view illustrating the hanger bar.

In reference to FIG. 15, the hanger groove 917 includes a lower surface 9171 formed in a bottom thereof and a supporting surface 9177 supportingly projected upward from the lower surface.

As shown in FIG. 16 that is the top sectional-view of the hanger bar, the hanger groove 917 formed in a width direction (W) of the hanger bar and the width (A1) of each end (C3 and C4) of the hanger groove 917 is larger than the width (A2) of a center of the hanger groove 917.

The hanging portion 210 received in the hanger groove 917 may point-contact with the hanger groove 917 in points (C1 and C2). If the hanger bar 91 is moved by the driving part, the hanging portion 210 may be movable in the rightward and leftward direction with respect to the contact points.

If the hanging portion 210 is moved in the rightward/leftward direction as shown in FIG. 15, the hanging portion will collide against a wall formed by the hanger groove between the contact points and the both ends.

As a result, the hanger bar including the hanger groove having the above appearance may shake the laundry hung on the hanger 200 such that the drying, sterilizing and wrinkle-removing process of the laundry may be performed efficiently, by extension, such that an energy generated in the collision between the ends of the hanger groove and the hanging portion 210 may be supplied to the laundry hung on the hanger only to improve the drying, sterilizing and wrinkle-removing process of the laundry more efficiently.

The shape of hanger groove 917 in the width direction (W) of the hanger bar shown in FIG. 16 is hyperbolic and alternatively the contact points C1 and C3 of the hanger bar may be linear.

Moreover, as shown in FIG. 17, the hanger bar 917 may be oblique, with the width (A3) getting smaller toward the lower surface 9171 of the hanger groove.

This is to accommodate the hanging portion 210 that can have diverse sized diameters. Specifically, if the hanger groove has a regular width in a direction of the hanger bar height (H), only the hangers having a predetermined diameter smaller than or equal to the width of the hanger groove. However, if the width of the hanger groove is getting smaller toward the lower surface as shown in FIG. 17, various types of hangers having diverse sizes of the hangers may be accommodated in the hanger groove.

In the meanwhile, an upper surface of the body 911 provided between the hanger grooves may have a predetermined curvature radius (r). This is because the hanging portion 210 should be re-accommodated in the hanger groove by the curvature radius (r) of the upper surface of the body even if the hanging portion 210 is separated from the hanger groove during the motion of the hanger bar 91 performed by the driving part.

The collision generated between the hanging portion 210 and the hanger groove may be embodied more efficiently according to a method of contact between the hanging portion and the hanger groove. As follows, the method of contact between the hanging portion 210 and the hanger groove will be described in reference to FIG. 6.

One-point contact between the hanging portion 210 and the supporting surface 9177 may be embodied if a curvature radius of the supporting surface is smaller than a curvature radius of the hanging portion and the present invention may not exclude a case of the supporting surface being formed of a projection projected upward from the lower surface 9171, different from FIG. 6 or 15. if the hanging portion 210 one-point-contact with the supporting surface 9177, the collision of the hanging portion with the hanger groove may occur more smoothly and efficiently when the hanger bar 91 moves horizontally in the rightward/leftward direction.

Also, if the hanging portion 210 may contact with both ends of the supporting surface 9177 to two-point-contact with the supporting surface 9177. If then, the supporting surface may have a horizontal-shaped upper surface, different from FIG. 6 or 15.

Here, the hanging portion 210 may be supported to both ends of the lower surface 9171, not both ends of the supporting surface, to two-point-contact with the hanger groove. Alternatively, the hanging portion may be supported to the ends of the supporting surface and the ends of the lower surface, to four-point-contact with the hanger groove.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treating apparatus comprising:

a treating chamber to accommodate laundry;

a supply device comprising an air supply device to supply air or heated air to the treating chamber and a steam generation device to supply steam to the treating chamber; and a moving hanger comprising a hanger bar provided in the treating chamber to support a hanger and a driving part to move the hanger bar within the treating chamber, wherein the hanger bar comprises:

a top surface having a width W, a front surface, a back surface, and a hanger groove extending in a width direction of the hanger bar to accommodate a hanging portion of the hanger, wherein a width A1 of the hanger groove at the front and back surface is larger than a width A2 of a center of the hanger groove, wherein each of A1 and A2 are within a single plane, and the shape of the hanger groove extending in the width direction of the hanger bar is hyperbolic, and wherein when the hanger bar is moved by the driving part, the hanging portion of the hanger pivots within the hanger groove and collides with hyperbolic shaped surfaces of the hanger groove.

2. The laundry treating apparatus as claimed in claim 1, wherein the hanger groove is oblique, with the width getting smaller toward a lower surface thereof.

3. The laundry treating apparatus as claimed in claim 1, further comprising:

a supporting surface projected from the lower surface of the hanger groove.

4. The laundry treating apparatus as claimed in claim 3, wherein the hanging portion of the hanger one-point-contacts with the supporting surface.

5. The laundry treating apparatus as claimed in claim 3, wherein the hanging portion of the hanger is supported by ends of the supporting surface of the hanger groove to two-point-contact with the hanger groove.

6. The laundry treating apparatus as claimed in claim 3, wherein the hanging portion of the hanger is supported by ends of the lower surface of the hanger groove to two-point-contact with the hanger groove.

7. The laundry treating apparatus as claimed in claim 3, wherein the hanging portion of the hanger is supported by ends of the lower surface and ends of the supporting surface of the hanger groove to four-point-contact with the hanger groove.

8. The laundry treating apparatus as claimed in claim 3, wherein the hanging portion of the hanger linear-contacts with the supporting surface.

* * * * *